US009595175B1

(12) United States Patent
Thoney

(10) Patent No.: US 9,595,175 B1
(45) Date of Patent: Mar. 14, 2017

(54) DOOR ALARM

(71) Applicant: Patrick Thoney, Eau Claire, WI (US)

(72) Inventor: Patrick Thoney, Eau Claire, WI (US)

( * ) Notice: Subject to any disclaimer, the term of this patent is extended or adjusted under 35 U.S.C. 154(b) by 0 days.

(21) Appl. No.: 14/554,876

(22) Filed: Nov. 26, 2014

Related U.S. Application Data

(60) Provisional application No. 61/910,743, filed on Dec. 2, 2013.

(51) Int. Cl.
*G08B 13/08* (2006.01)

(52) U.S. Cl.
CPC ..... *G08B 13/08* (2013.01)

(58) Field of Classification Search
None
See application file for complete search history.

(56) References Cited

U.S. PATENT DOCUMENTS 4,540,980 A 9/1985 Porco
4,801,928 A * 1/1989 Minter ..... G08B 7/066 340/309.4
4,851,814 A 7/1989 Rehberg
5,850,172 A 12/1998 Lenz
6,154,130 A 11/2000 Mondejar
6,259,365 B1 * 7/2001 Hagar ..... G08B 21/086 340/541
8,659,416 B1 * 2/2014 Higgins ..... G08B 5/38 340/514
2004/0036603 A1 * 2/2004 Bingham ..... G08B 13/19695 340/541

* cited by examiner

*Primary Examiner* — Travis Hunnings
(74) *Attorney, Agent, or Firm* — Anthony J. Bourget

(57) ABSTRACT

A portable door alarm including a front component connected to a rear component by a connecting component, the connecting component configured to be positioned at an edge of a door such as between a floor and a bottom edge of a door to which the alarm is associated so that the front component is positioned on a first side of the door and the rear component is positioned on an opposite side of the door, the rear component including an optical motion sensor configured to detect movement of the door. In one aspect the alarm is configured to fit upon a bottom edge of the door and to slide with the door as the door is opened or closed. In other aspects the front component includes an indicator and the rear component may include a variety of electrical components for various operational features. Various methods of operation are also provided.

21 Claims, 7 Drawing Sheets

DOOR ALARM

RELATED APPLICATIONS

This application claims the benefit and priority of Provisional Patent Application Ser. No. 61/910,743, filed Dec. 2, 2013, for DOOR ALARM, under 35 U.S.C. §119(e), incorporated herein by reference.

BACKGROUND OF THE INVENTION

1. Field of the Invention

The present invention relates to portable door alarms that connect to a door and more particularly to portable door alarms for indicating an unauthorized opening of a door.

2. Background Information

There are several types of devices developed for indicating the unauthorized entry into a residence or into a dorm room or hotel room or the like. While many alarms are built into the door or part of a larger security system, some devices have been developed that are portable and connect to a door or door jamb without harming the door. Some examples of portable door alarms include those found in patents such as U.S. Pat. No. 4,851,814, U.S. Pat. No. 6,154,130, U.S. Pat. No. 5,850,172, and U.S. Pat. No. 4,540,980. While these patented items and other systems may have useful features, there is room for improvement.

SUMMARY OF THE INVENTION

The alarm of the present invention allows people to feel secure while staying in (or returning to) a hotel room, dorm room, cabin, office, residence, or other room. In one aspect the device provides an alarm and indicator light when the door to the room is opened. The light remains lit until it is securely deactivated by the owner. This allows the consumer/owner to know if someone has entered the room. The device has an audio alarm to protect a user. An optional feature includes means for sending a message, text message, e-mail, and to take and send a photograph to a wireless phone or device to identify the person entering the room or signifying an intruder. Travelers can have peace of mind for their personal safety and that their important and valuable items are not in jeopardy of theft. The device is portable and does not require expensive wiring or retrofitting of doors.

In one aspect the device includes a portable door alarm having a front component including an indicator, a rear component including a motion sensor, and a connecting component connecting the front component to the rear component, the front component, the rear component and the connecting component defining a gap which receives an edge of a door to which the alarm engages.

In further aspects the invention includes an alarm device having an indicator positioned at a front component which front component is adjustably connected to a rear component via a connecting component, the connecting component configured to be positioned at an exterior edge of a door to which the alarm is associated. The device includes a motion sensor configured to detect movement of the door in order to activate an indicator and/or send a message to a user. A programmable controller may be included with the device to provide a variety of functions. In one example the alarm is configured to slide along the ground adjacent the swinging door.

In further aspects the invention includes methods of setting an alarm to a door and providing warning notice to a user. The alarm may adjust to fit different door panel thicknesses.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
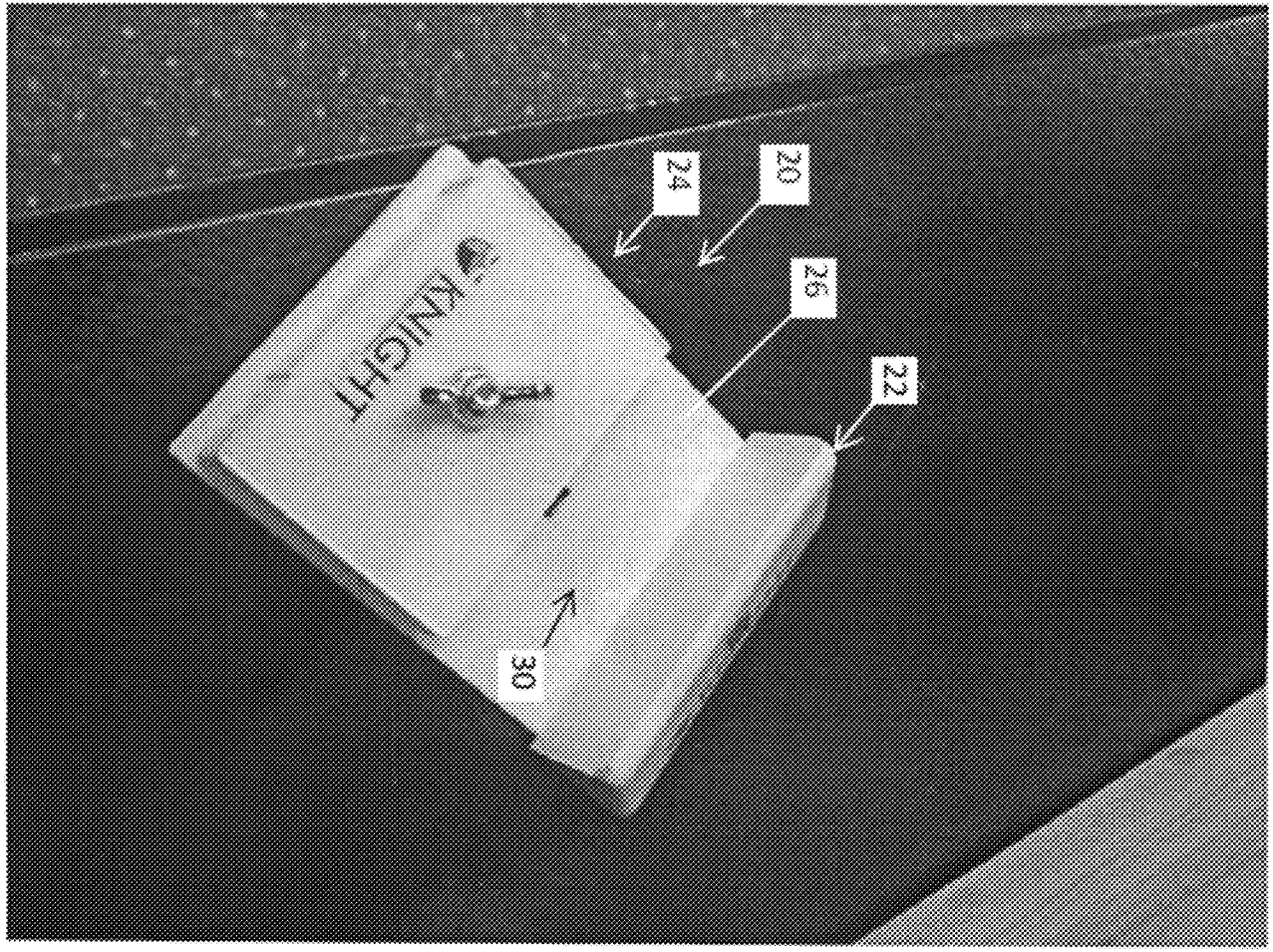
FIG. 1 is a perspective view of an alarm in accordance with one embodiment of the present invention.
Figure 2:
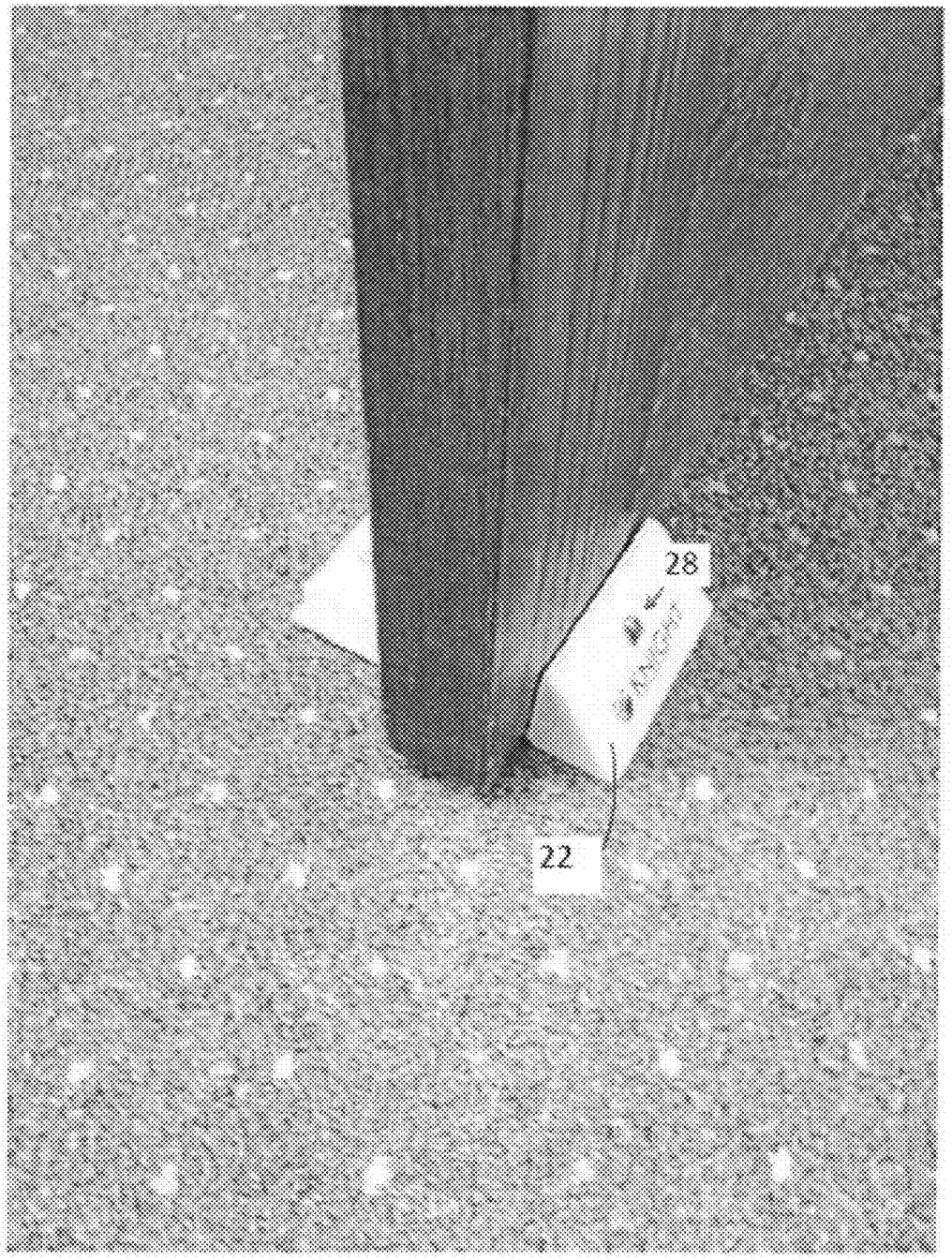
FIG. 2 is a front perspective view of the alarm of FIG. 1 placed on a floor and in conjunction with an open door.
Figure 3:
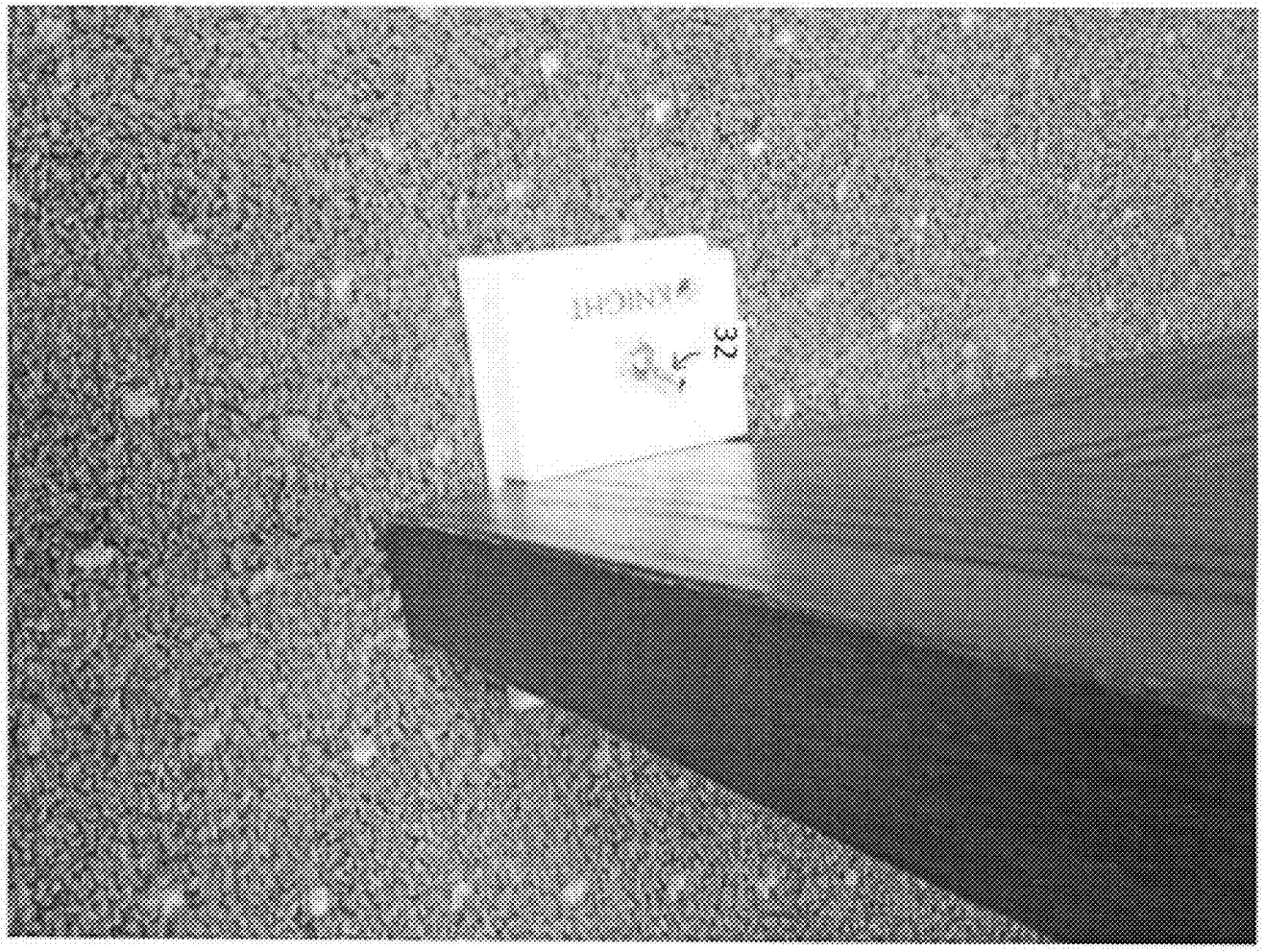
FIG. 3 is a rear perspective view of the alarm of FIG. 1 in conjunction with an open door.
Figure 4:
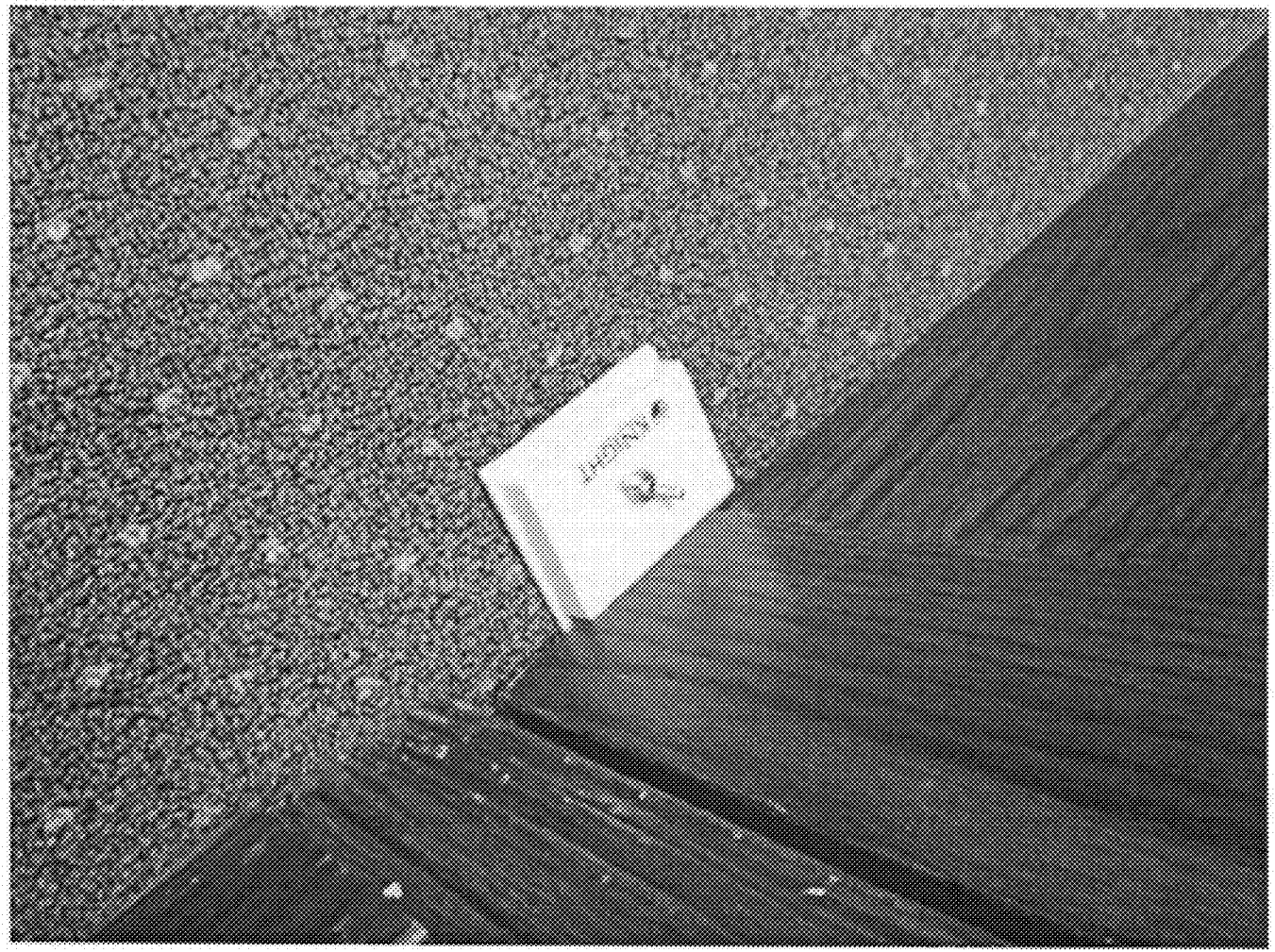
FIG. 4 is a rear perspective view of the alarm of FIG. 1 in conjunction with a closed door.
Figure 5:
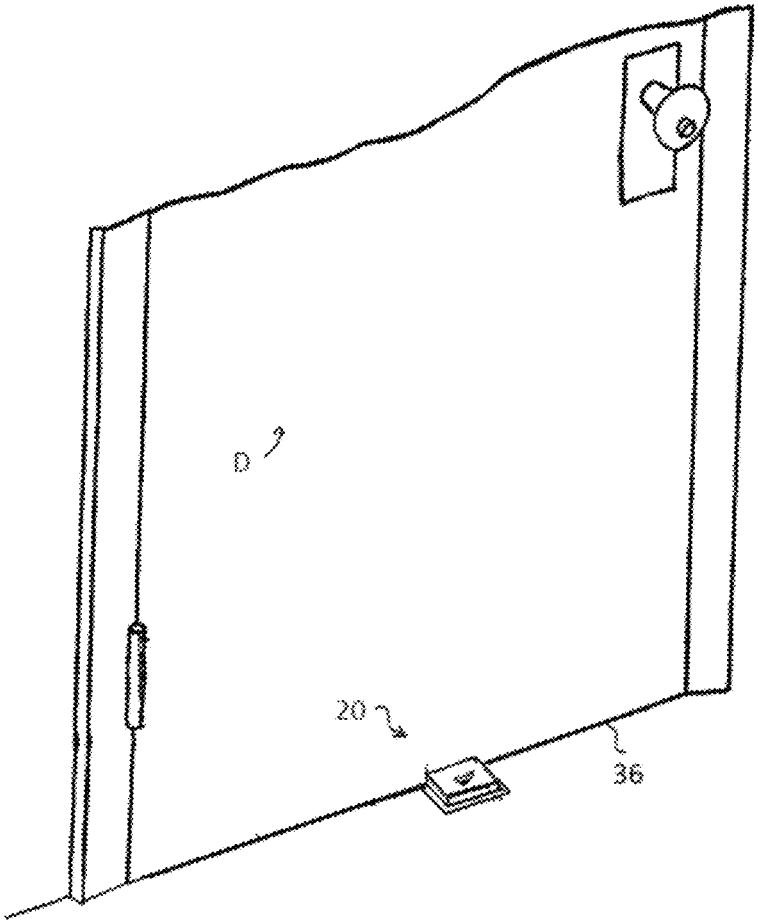
FIG. 5 is a rear perspective view of an alarm in accordance with the invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Referring to FIGS. 1-7, aspects of the alarm 20 are shown. In one aspect alarm 20 includes a front component 22, a rear component 24 and a connecting component 26. Connecting component 26 connects front component 22 to rear component 24. In one aspect front component 22 includes an indicator 28. Indicator 28 may include, for instance, a light such as an LED light or other light or bulb, or a speaker or other indicator.

In one aspect rear component 24 includes a sensor 40 to detect motion of alarm 20. When sensor 40 detects motion, such as when door D is opened, an alarm is activated. In one aspect the alarm includes indicator 28 which is positioned on the outside of door D. In other aspects the alarm includes a speaker 42 which emits an audible alarm. Speaker may be positioned at front compartment 22 or rear compartment 24, or both. In other aspects the alarm 20 includes a transmitter/receiver 38 which transmits (and/or receives) a wireless signal 44 (or a wired signal) which signal is configured to be received by an external receiver. The signal may be in the form of a text message or other signal which is configured to alert a user. The signal 44 may also include data or information, including photographic information taken by an optional camera 39. In one aspect, an external receiver may include a cellular telephone, smart phone or other personal device (or a computer) configured to receive cellular or data signals.

The monitoring, analysis, and determination techniques of the disclosure can be implemented in hardware, software, firmware or any combination thereof. In one aspect, rear component 24 includes a controller 34 which may include a computer chip or circuitry configured to control the electrical operation of alarm 20. In other examples, various aspects of the techniques may be implemented within one or more processors, including one or more microprocessors, DSPs, ASICs, FPGAs, or any other equivalent integrated or discrete logic circuitry, as well as any combinations of such components. Such hardware, software, firmware may be implemented within the same device or within separate devices to support the various operations and functions described in this disclosure. When implemented in software, the functionality ascribed to the systems, devices and techniques described in this disclosure may be embodied as instructions on one or more non-transitory computer-readable medium such as RAM, ROM, NVRAM, EEPROM, FLASH memory, magnetic data storage media, optical data storage media, or the like. The instructions may be executed to support one or more aspects of the functionality described in this disclosure. Rear component 24 is electrically connected to front component 22. In other aspects rear component 24 may communicate with front component 22 wirelessly. In one aspect electrical connection 23 connects component 22 to component 24. Connection 23 may be embedded within connecting component 26. In one aspect controller 34 is electrically connected to indicator 28.

In operation, sensor 40 (or multiple sensors if desired) can communicate with controller 34, and controller 34 can control alarm 20 based on the motion information or change of surroundings information generated by the sensor 40. Controller 34 is communicatively connected to sensor 40 (or sensors) and also to other devices, such as to speaker 42, camera 39 and/or transmitter 38. Controller 34 communicates with such devices via respective connections. Controller 34 includes processor 34 and memory 37. Signals generated by sensor 40 are communicated to controller 34 via a wired or wireless connection. Memory 37 stores software for running controller 34 and may also store data generated or received by processor 35, e.g., from sensor 40 (or from camera 39 or input mechanism 46. Processor 35 runs software stored in memory 37 to manage the operation of alarm 20.

When sensor 40 detects motion of door D, an electrical signal or current is supplied to indicator such as at indicator 28 to alert that the door D has been opened. Where indicator 28 is a light, controller 34 is configured to illuminate light 28 until a user re-sets the alarm 20. Having light 28 illuminated will indicate to a user, upon approaching his or her hotel room for instance, that the door had been opened while the user was away. The user will then be aware or "on guard" of the situation and may act or respond as needed. The indicator 28 will remain lit (or flashing) until the user re-sets the indicator by entering a code or information into an input mechanism 46 on alarm 20, for instance. Mechanism 46 may include a keypad, for instance. Mechanism may also include a display and also a touch screen display. Alarm 20 may also be configured to be activated/de-activated or set and re-set by use of a key fob or other means. Transmitter/receiver 38 may include a transponder or multiple transponders for sending and/or receiving signals and signal information.

Sensor 40 may comprise an optical sensor to optically detect motion and/or changes of light or other pattern changes. Thus, when alarm 20 is moved, sensor 40 may detect the motion by sensing changes in light patters or other optical changes. The signal from sensor 40 is sent to controller for comparison or processing to activate indicator 28 and/or camera 39 (or cameras 39) and/or speaker 42 and/or send a signal to a remote receiver. In one aspect controller 34 includes a memory 37 or computer chip to store information from calculation or comparison of data received from sensor 40. Sensor 40 may be configured to have no moving parts or may include mechanical switches or sensors as desired. Sensor 40 may include a variety of types of sensing features, including laser beam, roller-gear or wheel-gear mechanical mechanisms, mechanical switches and other motion detector means. While sensor 40 is shown to be positioned on rear component 24, sensor 40 may also be positioned on front component 22 or other location as desired. In other aspects sensor 40 may include a smoke detector, carbon monoxide detector, humidity detector, or other sensing capabilities.

Front component 22 connects to connecting component 26. Rear component 24 is configured to connect to connecting component 26 such that front component 22 and rear component 24 define a gap 30 which is configured to receive a door D. In one aspect gap 30 is configured to receive an edge 36 of door D. It may be appreciated that edge 36 of door D is an exterior edge of the door. In a further aspect gap 30 is configured to receive a bottom edge of door D. Alarm 20 may rest upon a floor while also being positioned to receive bottom edge of Door D within gap 30. Alarm 20 is configured such that rear component 24 is adjustable along connecting component 26. For instance, rear component 24 may slide toward and away from front component 22 in order to decrease or increase gap 30, respectively.

In one aspect alarm 20 includes an adjustment mechanism, such as adjustment screw 32 (FIG. 3) which is configured to allow for loosening of rear component 24 from connecting component 26 to accommodate adjustment. Particularly, loosening of adjustment screw 32 will allow a user to slide rear component 24 along connecting component 26 to vary the size of gap 30. Adjustment screw 32 may then be tightened so as to set rear component 24 in place against connecting component 26. Adjustment screw 32 may be made of many different varieties adapted to allow a user to make easy manual adjustment to the alarm 20. Adjustment screw 32 may include a thumb screw or other adjusting device which when released allows rear component 24 adjust in relationship to front component 22 to vary the gap 30.

In one aspect a ratchet mechanism is included which allows a user to press or pinch on the edge of the ratchet to loosen and slide rear component 24 along connecting component 26. Release of ratchet secures rear component 24 into a fixed position upon connecting component 26. Ratchet may be made of plastic, for instance. Ratchet may include a series of teeth that inset within a corresponding tooth or set of teeth for desired flexible adjustment. It may be appreciated that alarm 20 is configured to be removed from a door (and/or connected to a door) without altering the door in any way. For instance, in aspects of the invention there are no holes to drill in the door, no parts to glue to the door, no special treatments required of the door in any way. The alarm 20 is configured such that when it is removed, the door is unchanged.

Alarm 20 may be made of a variety of types of materials. While other materials may also be used, in one example front component 22, rear component 24, and connecting component 26 are made of plastic.

Figure 6:
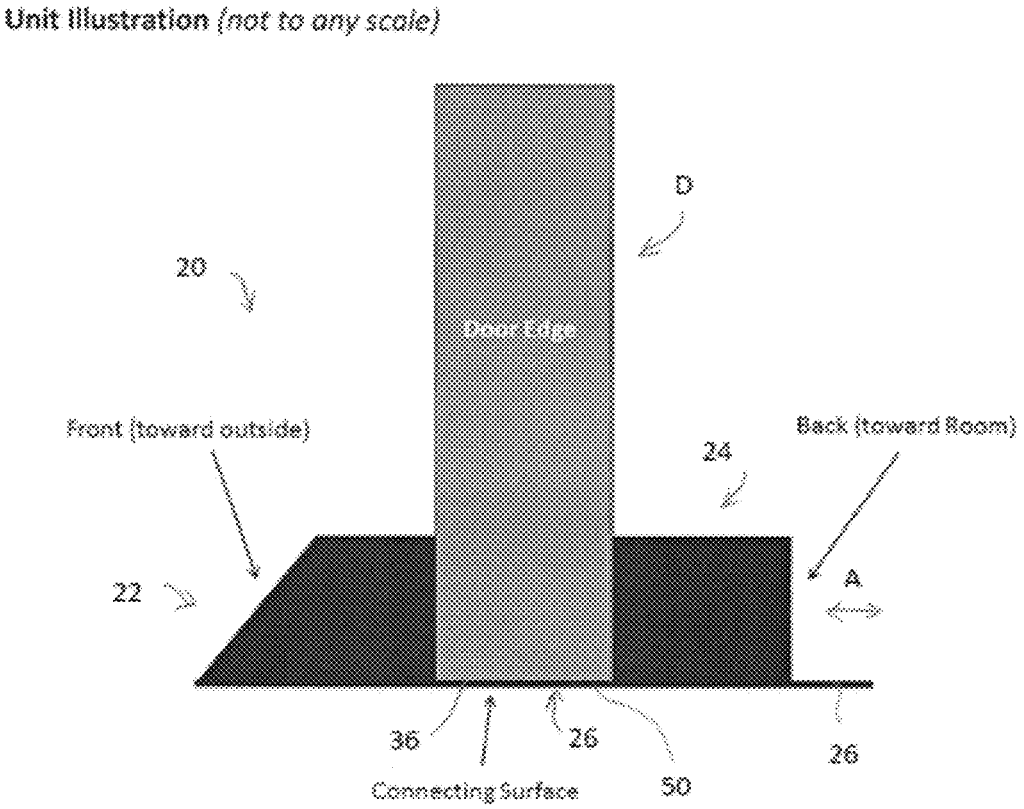
FIG. 6 is a side view illustration of the alarm in accordance with further aspects of the invention and in conjunction with a door.

In operation a user will adjust rear component 24 upon connecting component 26 to provide an appropriate gap 30 to match the thickness of door D. In one aspect the gap 30 matches the thickness of door D at a bottom edge 36. For instance a user may slide alarm 20 onto door edge 36 so that connecting component 26 is positioned between the floor and bottom edge 36. Thereafter the user may slide rear component toward front component 22 so that rear component 24 and front component 22 both abut door D (or nearly abut door D as desired). Rear component 24 may adjust with respect to connecting component 26 along arrow A (FIG. 6). Adjusting component 24 along component 26 away from component 22 increases gap 30. Adjusting component 24 toward component 22 decreases gap 30. A friction fit of alarm 20 upon door D is achieved upon decreasing gap 30 and tightening adjustment screw 32, for instance. It may be appreciated that alarm 20 will also operate to slide with or in conjunction with the opening or closing of door D even if a friction fit is not achieved. For instance, the gap 30 may be slightly larger than width of door edge such that the door will push or pull alarm 20 along the floor as door D is opened or closed. Once the gap 30 is set and alarm 20 is secured to door D, the door may be closed and opened. Alarm 20 will slide along the ground when opening or closing the door. Bottom side 50 of alarm 20 is configured to slide along the floor. In one aspect bottom side 50 is made of smooth plastic to enhance sliding of alarm 20. It may be appreciated that alarm 20 straddles an exterior edge of the door while portions of the alarm extend at least partially over opposite sides of the door as shown generally in FIG. 6.

When alarm 20 is secured to or positioned at door D, a user may set or arm the alarm 20. A user may set the alarm by pressing a button or buttons on input 46. In one aspect the alarm 20 may be armed by the user pressing a key fob or pressing a button or utilizing an application program on a smart phone or other device. A key fob (or smart phone) transmits a signal that may be paired with alarm 20 for activation/deactivation. A signal from the key fob or phone is received by transmitter/receiver 38. Transmitter/receiver communicates electrically or wirelessly with controller 34 to arm or disarm alarm 20. An alternative keypad or input mechanism 46 may also be positioned on rear component 24 for entry of information or commands for use by controller 34. Alarm 20 may be configured with a built in delay so that a user has a set period of time to set the alarm in position at the edge of the door, exit the door and close the door behind. After the time delay, such as 10 seconds, alarm 20 is armed such that upon movement of the door, the indicator 28 will light (or other action consistent with this disclosure will ensue). Various data may be collected, saved and transmitted via alarm 20, including the time of day of an alarm event, the duration of the event, the reason for the alarm, instances of tampering with alarm 20 among other data aspects. During an alarm event or otherwise a signal may also be sent to a call center to notify appropriate security.

Figure 7:
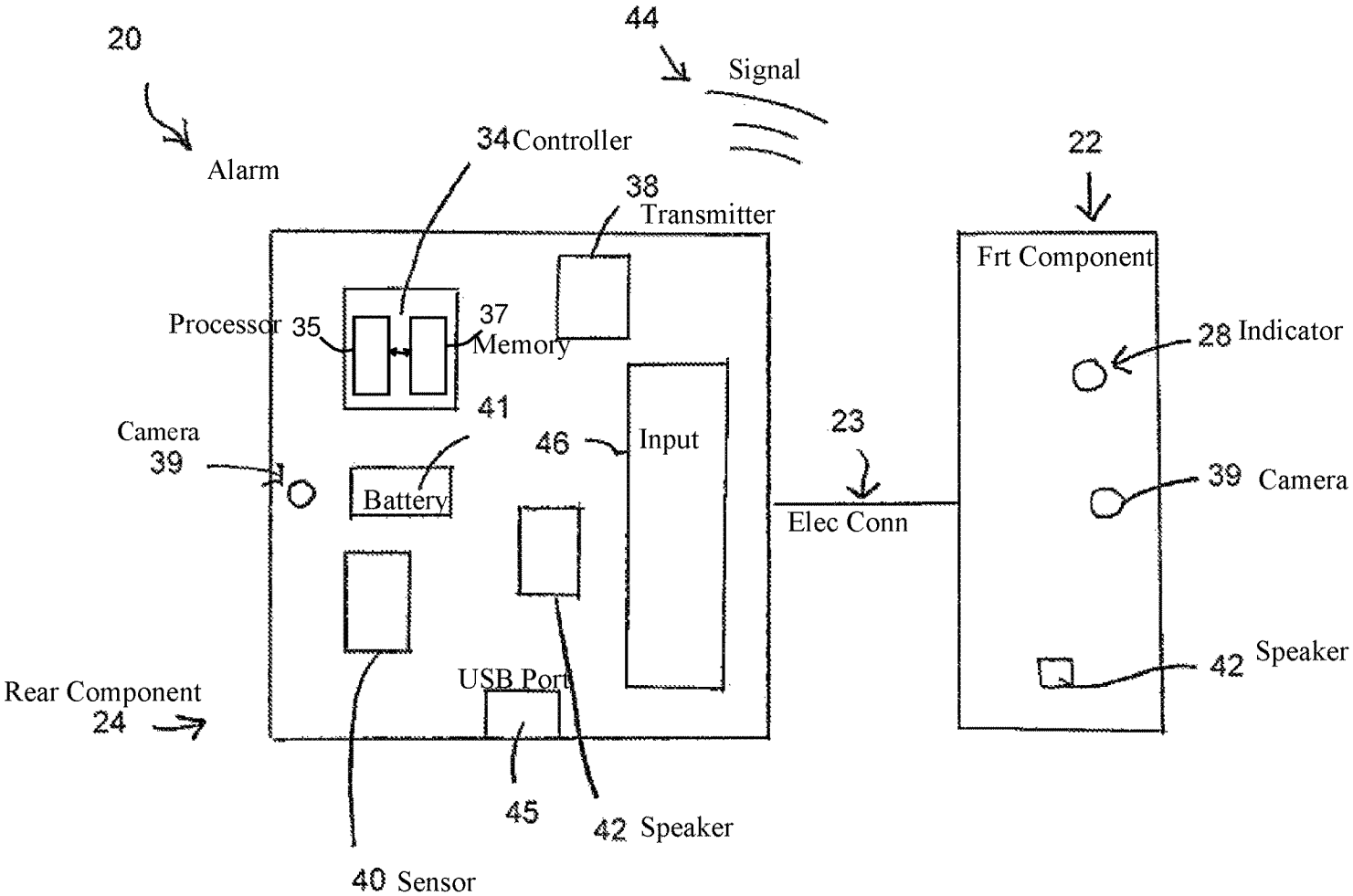
FIG. 7 is a diagram of an alarm in accordance with further aspects of the invention.

With reference to FIG. 7, rear component 24 may include a number of electrical elements. Controller 34 may be electrically connected to all of these components to operate overall control of alarm 20. Controller 34 may be programmed and/or reprogrammed to execute various operations. Alarm 20 may include a camera 39 which is programmed to take a photo or video at a defined event, such as during the opening of door D and at various intervals as desired or as programmed. Camera 39 may also be noise activated to capture video (and record audio) of the surroundings and store the captured information in memory 37 or transmit the information. Sensor 40 in one aspect is a motion sensor which detects changes in light or images or background images. As component 24 is moved, sensor 40 will detect such motion which in turn results in a signal to controller. Sensor 40 may include a mechanical activated sensor, solid state sensor, CCD array sensor, a trembler switch, or other switch or other sensing device used to detect motion of alarm 20. In one aspect sensor 40 may be angled or include a light beam or laser oriented toward the floor. When the door swings open, the sensor 40 will observe travel along the floor (and the associated visual change) in order to activate a warning event. Alarm 20 (and associated sensor 40 and/or control 34) may be adjusted to control the sensitivity of motion detection. Battery 41 powers alarm 20. Speaker 42 may be configured to emit an alarm as programmed. Controller 34 may also include a memory chip or chips to be programmed for various operations of alarm 20. Event data may be stored in the chip and/or transmitted from transmitter 38. A power outlet and/or USB port 45 may be used to recharge battery 41 and to program chip/controller 34 and/or receive data from chip/controller 34. Alarm 20 (and controller 34) may also be configured to be programmed wirelessly. Rear component 24 may also include a smoke detector and/or heat or thermal sensor or switch. It may be appreciated that the foregoing electrical components, or some of them, may be contained in or on a single chip or electrical board and positioned within a housing of rear component 24. It may also be appreciated that some of the electrical components may be positioned at front component 22.

A further aspect of the invention includes the method of moving a door equipped with the alarm 20. In further aspects the method includes a step of detecting motion of the door, a step of activating an indicator or warning, a step of transmitting a signal and/or message, a step of calibration of sensitivity of the motion sensing means, a step of programming the alarm, a step of taking a photograph or video, a step of adjusting the alarm to affix to a bottom edge of a door and a step of sliding the alarm along a floor while opening or closing a door.

It may be appreciated that alarm 20 may also be positioned at various edges of door D (such as at or along a side edge or top edge) and need not be limited to positioning along a bottom edge of a door. After use at one room location or door D, a user may remove the portable alarm 20 to be used at a different location. For instance, a user may slide alarm 20 along the edge and to the end of the door for removal, or may separate rear component 24 from front component 22 for removal. Alarm 20 may be placed into a briefcase, suitcase, purse or other carrier for transport and re-use. Alarm 20 may include a single board computer, and may also include the componentry typically found in a cellular phone, including a smart phone.

In a further aspect of the invention an application program is available for use on a cellular telephone or smart phone for operation of alarm 20. By use of the application program a signal may be sent from a cellular phone and received by alarm 20, and vice versa. The cellular phone application is configured to allow a user to activate/deactivate alarm 20 and control the functions of alarm 20. The application may also be configured to send a message to a call center or other location. The application program may also include a pre-registration function to integrate with a hotel reservation, for instance, and to integrate with alarm 20. An application program may be downloaded to a user's cellular telephone for a fee or subscription. Data reports and other functionality may be generated by alarm 20 and transmitted to a phone via the application program. Messages may be exchanged between alarm 20 and the cellular phone via text messages and/or via an application program. A user of a cellular telephone may monitor in real-time the environment of the alarm 20 (via use of audio, video and/or other data information sent from alarm 20 to the cell phone). A user may program the various functions of alarm 20 via use of the phone application program.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular DOOR ALARM as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A portable door alarm comprising:

a front component including an indicator;

a rear component including a motion sensor and a battery which powers said portable door alarm; and a connecting component connecting said front component to said rear component, said front component, said rear component and said connecting component defining a gap which receives an exterior edge of a door to which said alarm can be engaged.

2. A portable door alarm comprising: a front component including an indicator, said front component configured to be positioned at an outside side of a door; a rear component including a motion sensor, said rear component configured to be positioned at a side opposite the outside side; and a connecting component connecting said front component to said rear component, said front component, said rear component and said connecting component defining a gap which receives an exterior edge of a door to which said alarm may be engaged and where said connecting component is configured to be positioned between a floor and a bottom edge of a door.

3. The alarm of claim 1 where said indicator includes a light.

4. The alarm of claim 1 where said motion sensor is an optical motion sensor.

5. The alarm of claim 1 where said connecting component includes an electrical connection electrically connecting said indicator to circuitry of said rear component.

6. The alarm of claim 1 where said connecting component includes a flat bottom side configured to slide along a floor, said flat bottom side having a length measuring greater than a height of said rear component.

7. The alarm of claim 1 where said indicator is configured to turn on upon opening of a door which said alarm is engaged.

8. The alarm of claim 1 further comprising a controller configured to send a signal to said indicator upon opening of the door.

9. The alarm of claim 8 where said alarm is configured to send a wireless signal to a receiver to notify of opening of the door.

10. The alarm of claim 1 where said rear component is configured to be adjusted upon said connecting component to vary the gap.

11. A door alarm comprising:

a front component including an indicator; and a rear component having a battery which powers said door alarm, said rear component connected to said front component by a connecting component, said rear component and said front component configured to be positioned on opposite sides of a door to which said alarm is engaged, said indicator electrically connected to said rear component.

12. The alarm of claim 11 where said connecting component is configured to be positioned between a floor and a bottom edge of a door to which said alarm connects.

13. A door alarm comprising:

a front component including an indicator; and a rear component connected to said front component by a connecting component, said rear component and said front component configured to be positioned on opposite sides of a door to which said alarm is engaged, said indicator electrically connected to said rear component where said rear component includes a controller configured to activate said indicator upon opening of the door.

14. The alarm of claim 13 where said controller includes a processor and a memory, said memory configured to store data pertaining to an alarm event.

15. The alarm of claim 14 further comprising a receiver/transmitter configured to send and/or receive wireless signal data.

16. A method of setting a door alarm comprising straddling an exterior edge of the door with said device of claim 11.

17. A portable door alarm comprising: a front component configured to be positioned at an outside of a door, said front component having an indicator and adjustably connected to a rear component by a connecting component, said connecting component configured to be positioned at an edge of a door to which said alarm is associated so that said front component is positioned on a first side of the door and said rear component is positioned on an opposite side of the door, said rear component including a speaker and including a motion sensor configured to detect movement of the door in order to activate said indicator and also to activate said speaker.

18. The alarm of claim 1 further comprising a smoke detector positioned at said rear component.

19. The alarm of claim 1 further comprising a camera and configured to send an image in the form of wireless signal, said camera configured to activate upon motion of the door.

20. The alarm of claim 1 configured to send video images.

21. The alarm of claim 1 where said rear component includes a controller configured to activate said indicator.

* * * * *